US007029355B1

(12) United States Patent
Smith

(10) Patent No.: US 7,029,355 B1
(45) Date of Patent: Apr. 18, 2006

(54) RECREATIONAL FLOATATION APPARATUS

(76) Inventor: J. Grady Smith, 3552 Lake Carlton Rd., Loganville, GA (US) 30052

( * ) Notice: Subject to any disclaimer, the term of this patent is extended or adjusted under 35 U.S.C. 154(b) by 0 days.

(21) Appl. No.: 11/092,411

(22) Filed: Mar. 29, 2005

(51) Int. Cl.
*B63C 9/28* (2006.01)

(52) U.S. Cl. ..... 441/130

(58) Field of Classification Search ..... 441/129, 441/130, 131
See application file for complete search history.

(56) References Cited

U.S. PATENT DOCUMENTS

| | | | | |
|---|---|---|---|---|
| 146,426 | A | 1/1874 | Borgfeldt | |
| 802,275 | A | 10/1905 | Fentrick | |
| 1,126,283 | A | 1/1915 | Ritson | |
| 1,689,721 | A | 10/1928 | Harris | |
| 1,829,137 | A | 10/1931 | Harris | |
| 2,257,103 | A | 9/1941 | Brokering | |
| 2,859,458 | A | 11/1958 | Calarco | |
| 2,974,331 | A * | 3/1961 | Dize | 441/130 |
| 3,292,566 | A * | 12/1966 | Russell | 114/219 |
| 3,380,088 | A | 4/1968 | D'Adesky | |
| 4,358,866 | A | 11/1982 | Rhodes | |
| 4,662,851 | A * | 5/1987 | Foster | 441/129 |
| 4,824,411 | A | 4/1989 | McClanahan | |
| 5,088,723 | A * | 2/1992 | Simmons | 472/129 |
| 5,273,473 | A * | 12/1993 | Allen | 441/129 |
| 5,928,046 | A | 7/1999 | Constan-Tatos | |
| 6,132,276 | A | 10/2000 | Leemon | |
| 6,843,695 | B1 * | 1/2005 | Jackson et al. | 441/129 |
| 6,901,619 | B1 * | 6/2005 | Hsia | 5/710 |

* cited by examiner

*Primary Examiner*—Stephen Avila
(74) *Attorney, Agent, or Firm*—Myers & Kaplan LLC; Greg O'Bradovich, Esq.; Barry E. Kaplan, Esq.

(57) ABSTRACT

A recreational floatation apparatus. The apparatus has a generally square frame having several floatation cylinders are attached. Additional floatation cylinders are added at the front and back for further cushioning and floating power. The apparatus can include a pull rope or chain so that the apparatus can be pulled or connected to another apparatus to create a longer floatation device or, if propped, a lounger.

12 Claims, 3 Drawing Sheets

RECREATIONAL FLOATATION APPARATUS

BACKGROUND

I. Field of the Invention

The present invention relates generally to the field of recreational activities and more particularly to a floatation apparatus.

II. Description of the Related Art

Present recreational floatation devices are typically a single elongated piece manufactured of Styrofoam or other suitable material that floats. Other recreational floatation devices are inflatable. While these devices are suitable for use in pools and other calm water, their use in the ocean, where waves are present is typically not desirable. The single piece floatation devices offer the disadvantage that as waves pass by the device, the device tends to be carried along with the wave or be capsized. These devices do not offer any locations through which the water can pass and leave the device in a relatively stable position. As such, lying out or calmly floating on rough water can be interrupted by the presence of waves.

SUMMARY

In general, the invention features a floatation apparatus. The apparatus has a generally square frame having several cross ropes or chains onto which individual floating cylinders are attached. The frame is typically PVC pipes with elbows at appropriate connection sections. In another embodiment, chains can be used as the frame. Additional floatation cylinders are added at the front and back for further cushioning and floating power. The apparatus includes a pull rope or chain so that the apparatus can be pulled or connected to another apparatus to create a longer floatation device or, if propped, a lounger. By having several separate floatation cylinders, the apparatus better handles the water by allowing water to pass through the spaces in between the floatation cylinders while still providing floatation. In particular, as waves in the ocean pass over the apparatus with a user on the apparatus, the apparatus better maintains an upright orientation by allowing the force of the waves pass through the spaces.

In general, in one aspect, the invention features a floatation apparatus, including a generally polygonal frame having an upper tube parallel to a lower tube, and two parallel side tubes, a plurality of generally adjacent and parallel floatation cylinders located within the frame, generally perpendicular to the side tubes and parallel to the upper and lower tubes, each cylinder having a hollow center along a longitudinal axis and an elongated connection tie connecting each of the floatation cylinders to the frame.

In one implementation, the apparatus further includes an additional floatation cylinder surrounding the upper tube.

In another implementation, the apparatus further includes an additional floatation cylinder surrounding the lower tube.

In another implementation, the elongated tie is a band connected end to end forming a continuous loop that is disposed through the hollow center of each floatation cylinder and looped around each of the side tubes.

In another implementation, the apparatus further includes an elbow located at each corner of the frame.

In another implementation, the apparatus further includes an elongated rod located within the each of the side tubes.

In still another implementation, the side tubes comprise a plurality of holes aligned with an adjacent hollow center of an adjacent floatation cylinder.

In yet another implementation. the elongated tie is a rope connected end to end forming a continuous loop located within the hollow center of each floatation cylinder and through a corresponding hole on each of the side tubes, and further looped around the elongated rods within the side tubes.

In another implementation, the hollow cylinders are closed cell polyethylene foam.

In another aspect, the invention features a recreational system, including a first floatation apparatus, including, a generally polygonal frame having an upper tube parallel to a lower tube, and two parallel side tubes, a plurality of generally adjacent and parallel floatation cylinders located within the frame, generally perpendicular to the side tubes and parallel to the upper and lower tubes, each cylinder having a hollow center along a longitudinal axis and an elongated connection tie connecting each of the floatation cylinders to the frame, a second floatation apparatus connected to the first floatation apparatus, the second apparatus including a generally polygonal frame having an upper tube parallel to a lower tube, and two parallel side tubes, a plurality of generally adjacent and parallel floatation cylinders located within the frame, generally perpendicular to the side tubes and parallel to the upper and lower tubes, each cylinder having a hollow center along a longitudinal axis and an elongated connection tie connecting each of the floatation cylinders to the frame.

In one implementation, the first and second apparatuses are hingably connected to one another at first ends of the frames by ties.

In another implementation, second ends of the frames are connected to one another by elongated ties.

In another implementation, the elongated ties are adjustable to fix an angular orientation between the two apparatuses.

In another implementation, the elongated ties adjust to a length such that the apparatuses are arranged in an angular orientation sufficient to allow a user to sit in a lounged position.

In another implementation, the system further includes a planar adjustment plate connected to ends of each elongated tie.

In still another implementation, the planar adjustment plate includes three holes, the elongated ties being knotted at one end and threaded through a first hole through an upper surface of the plate, through a second hole through a lower surface of the plate and through a third hole through the upper surface of the plate.

In yet another implementation, the plate is triangular.

In another implementation, the ties are nylon rope.

In another implementation, the elongated ties are nylon rope.

In still another aspect, the invention features a recreational floatation apparatus, including a rectangular tubular frame, means for floating the frame located within the frame, and means for retaining the means for floating the frame within the frame.

One advantage of the invention is that waves can pass through the several openings present in the apparatus.

Another advantage of the invention is that it can be converted to a lounger.

Other objects, advantages and capabilities of the invention are apparent from the following description taken in conjunction with the accompanying drawings showing the preferred embodiment of the invention.

DETAILED DESCRIPTION

Figure 1:
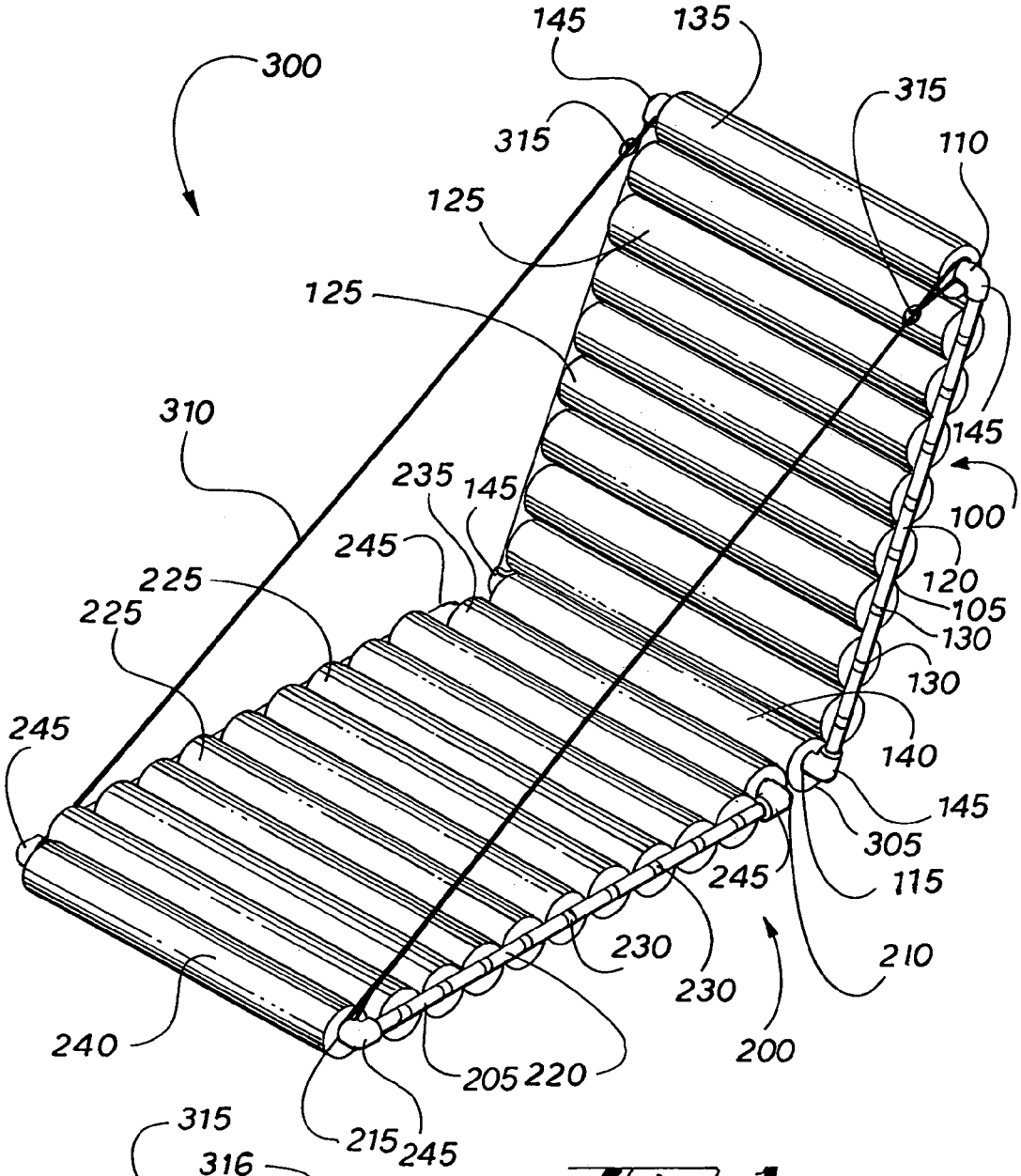
FIG. 1 illustrates a perspective view of an embodiment of two floatation apparatuses connected together to form an embodiment of a lounger apparatus in an open position.

Referring to the drawings wherein like reference numerals designate corresponding parts throughout the several figures, reference is made first to FIG. 1 illustrates a perspective view of an embodiment of two floatation apparatuses 100, 200 connected together to form an embodiment of a recreational system 300 or lounger apparatus in an open position. Each apparatus generally includes a generally polygonal frame 105, 205 having an upper tube 110, 210 parallel to a lower tube 115, 215, and two parallel side tubes 120, 220. Each apparatus 100, 200 further includes a plurality of generally adjacent and parallel floatation cylinders 125, 225 located within the frame 105, 205. The cylinders 125, 225 are generally perpendicular to the side tubes 120, 220 and parallel to the upper tubes 110, 220 and lower tubes 115,215, each cylinder 125,225 having a hollow center along a longitudinal axis.

Each apparatus 100, 200 typically includes an elongated connection tie 130, 230 connecting each of the floatation cylinders 125, 225 to the respective frame 105, 205. The elongated connection ties 130, 230 are discussed in further detail in the description below. In addition, each apparatus 100, 200 includes an additional floatation cylinder 135, 235 surrounding the upper tubes 110, 210 and an additional floatation cylinder 140, 240 surrounding the lower tubes 115, 215. Since it is desirable that the apparatuses 100, 200 alone and combined as the system 300, float, the cylinders are a material that is capable of floating, light weight and resistant to absorbing water. In a typical embodiment, the cylinders are closed cell polyethylene foam. It is understood and appreciated that the cylinders can be other materials in other embodiments.

The apparatuses 100,200 typically further include an elbow 145,245 located at each corner of the frames 105, 205. It is appreciated that the elbows 145, 245 connect all of the respective tubes together to form the frames 150, 205 that are typically rectangular. It is further appreciated that although other shapes are contemplated, the rectangular shape allows a user to lie on either apparatus 100, 200 individually as a single floatation device or as shown in the figure as a lounger. Different lengths of the apparatuses 100, 200 are further contemplated in other embodiments to accommodate users of varying heights. In a typical embodiment, the frames 105, 205 (including all respective tubes and elbows) are a light weight and durable material such as plastic. For example, the frames 105,205 can be poly vinyl chloride (PVC). Suitable adhesive or other glues can be used to connect together the constituent pieces of the frames 105, 205.

FIG. 1 further illustrates that the system 300 includes short ties 305 that hingably connect the first and second apparatuses 100, 200 to one another at the ends of the frames 105,205 that are adjacent one another. In addition, the other ends of the frames 105, 205 are also connected to one another by elongated ties 310. The shorter ties 305 are used to create a pivot point for the apparatuses 100, 200 so that different lounge positions can be chosen. The elongated ties 310 are used to fix the angular orientation of the apparatuses 100, 200 with respect to each other. In general, the elongated ties 310 adjust to a length such that the apparatuses are arranged in an angular orientation sufficient to allow a user to sit in a lounged position. A planar adjustment plate 315 is connected to ends of each elongated tie 310 so that the length of the elongated ties 310 can be adjusted.

Figure 1A:
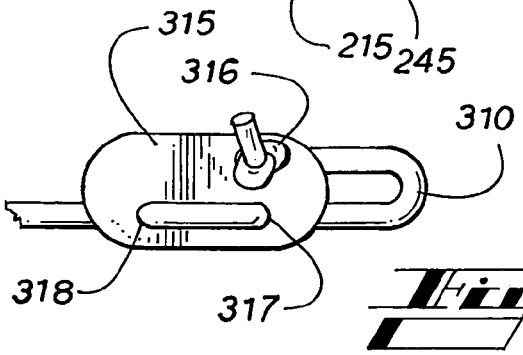
FIG. 1A illustrates a top view of an embodiment of a planar adjustment plate.

FIG. 1A illustrates a top view of an embodiment of a planar adjustment plate 315. The planar adjustment plate 315 generally includes three holes 316, 317, 318. The elongated ties 310 are typically knotted at one end and threaded through the first hole 316 through an upper surface of the plate 315, through the second hole 317 through a lower surface of the plate 315 and through the third hole 318 through the upper surface of the plate 315. A user can therefore easily adjust the length of the ties 310 by loosening the ties 310 at the plate 315 and adjusting the length as needed. The frictional forces between the ties 310 and the holes 316, 317, 318 of the plate 315 keep the ties 310 fixed in a desired position. In a typical embodiment, the plate 315 is triangular that allows the holes 316, 317, 318 to have an angular orientation with respect to the elongated ties 310 that, in turn, aids in increasing the frictional forces. In addition, the elongated ties 310 are typically nylon rope that aids in increasing the frictional forces and yet typically does not fray.

Figures 2, 3:
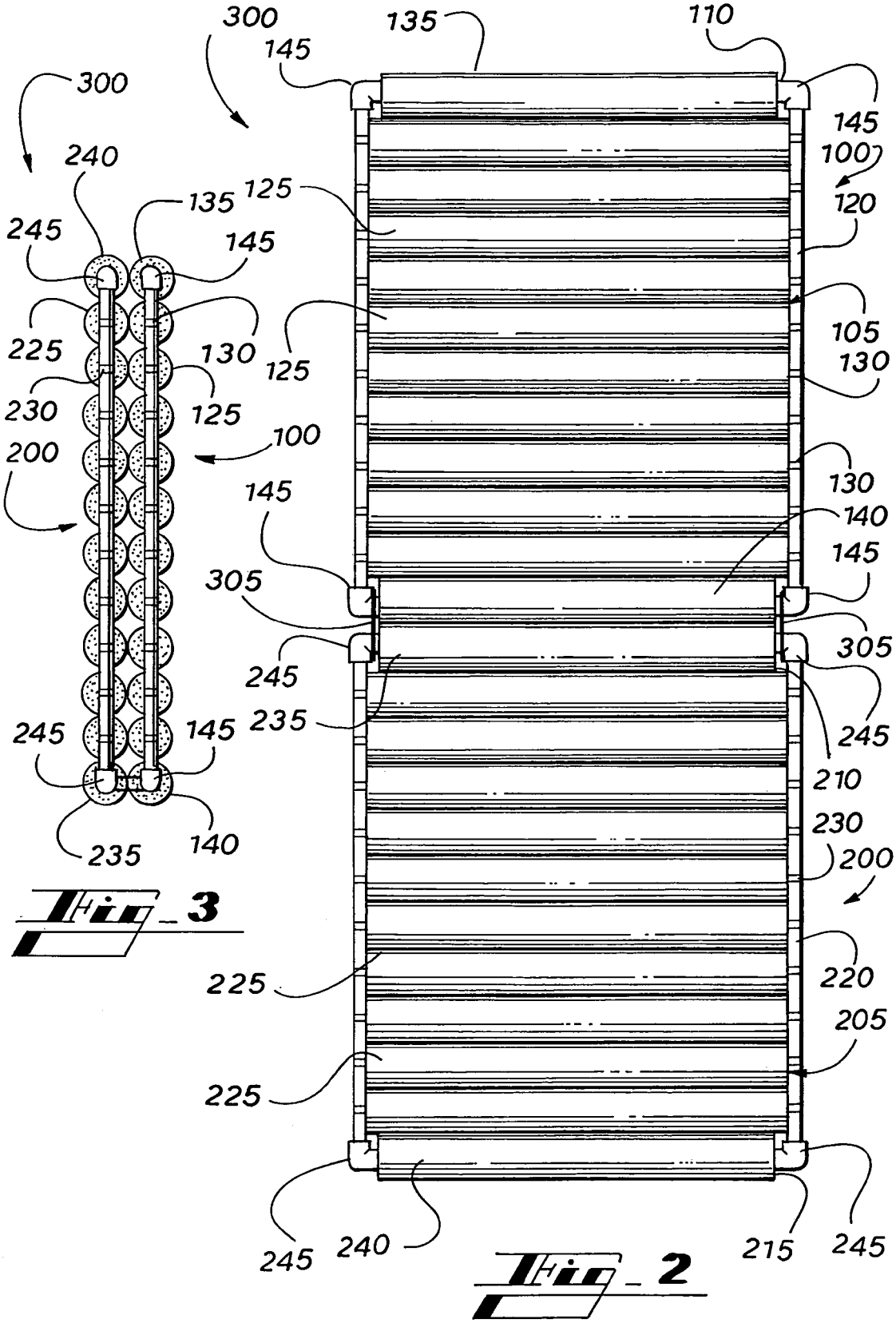
FIG. 2 illustrates a top view of an embodiment of two floatation apparatuses connected together to form an embodiment of a lounger apparatus in a fully open position.
FIG. 3 illustrates a side view of an embodiment of two floatation apparatuses connected together to form an embodiment of a lounger apparatus in a fully closed position.

FIG. 2 illustrates a top view of an embodiment of two floatation apparatuses 100, 200 connected together to form an embodiment of a lounger apparatus, or recreational system 300 in a fully open position. As described above, each apparatus 100, 200 generally includes a generally polygonal frame 105,205 having the upper tube 110,210 parallel to the lower tube 115, 215, and two parallel side tubes 120, 220. Each apparatus 100, 200 further includes a plurality of generally adjacent and parallel floatation cylinders 125, 225 located within the frame 105, 205. The cylinders 125, 225 are generally perpendicular to the side tubes 120, 220 and parallel to the upper tubes 110, 220 and lower tubes 115, 215, each cylinder 125, 225 having a hollow center along a longitudinal axis.

Each apparatus 100, 200 typically includes an elongated connection tie 130, 230 connecting each of the floatation cylinders 125, 225 to the respective frame 105, 205. In addition, each apparatus 100, 200 includes the additional floatation cylinder 135, 235 surrounding the upper tubes 110, 210 and an additional floatation cylinder 140, 240 surrounding the lower tubes 115, 215. The apparatuses 100, 200 typically further include the elbow 145, 245 located at each corner of the frames 105, 205. It is appreciated that the elbows 145, 245 connect all of the respective tubes together to form the frames 150, 205.

The system 300 includes short ties 305 that hingably connect the first and second apparatuses 100, 200 to one another at the ends of the frame 1005, 205 that are adjacent one another. The elongated ties 310 are not shown since the system 300 is in the fully open position.

FIG. 3 illustrates a side view of an embodiment of two floatation apparatuses 100, 200 connected together to form an embodiment of a lounger apparatus, or recreation al system 300 in a fully closed position. This closed position illustrates that the system 300 can advantageously be closed into a compact easy to carry form. As described above, each apparatus 100,200 generally includes a generally polygonal frame 105,205 having the upper tube 110,210 parallel to the lower tube 115, 215, and two parallel side tubes 120,220. Each apparatus 100, 200 further includes a plurality of generally adjacent and parallel floatation cylinders 125, 225 located within the frame 105, 205. The cylinders 125, 225 are generally perpendicular to the side tubes 120, 220 and parallel to the upper tubes 110, 220 and lower tubes 115, 215, each cylinder 125, 225 having a hollow center along a longitudinal axis.

Each apparatus 100, 200 typically includes an elongated connection tie 130, 230 connecting each of the floatation cylinders 125, 225 to the respective frame 105, 205. In addition, each apparatus 100, 200 includes the additional floatation cylinder 135, 235 surrounding the upper tubes 110, 210 and an additional floatation cylinder 140, 240 surrounding the lower tubes 115, 215. The apparatuses 100, 200 typically further include the elbow 145, 245 located at each corner of the frames 105, 205. It is appreciated that the elbows 145, 245 connect all of the respective tubes together to form the frames 150, 205.

The system 300 includes short ties 305 that hingably connect the first and second apparatuses 100, 200 to one another at the ends of the frames 105, 205 that are adjacent one another. The elongated ties 310 are not shown since the system 300 is in the fully open position.

It is appreciated that although the apparatuses 100, 200 have been shown connected together as a system 300, an individual apparatus 100, 200 can be used as a single floatation device by removing the short ties 305. It is also appreciated that additional ropes or other suitable ties can be connected to the apparatuses 100, 200 as leads to pull or carry the apparatuses 100, 200 or the entire system 300.

Figure 4:
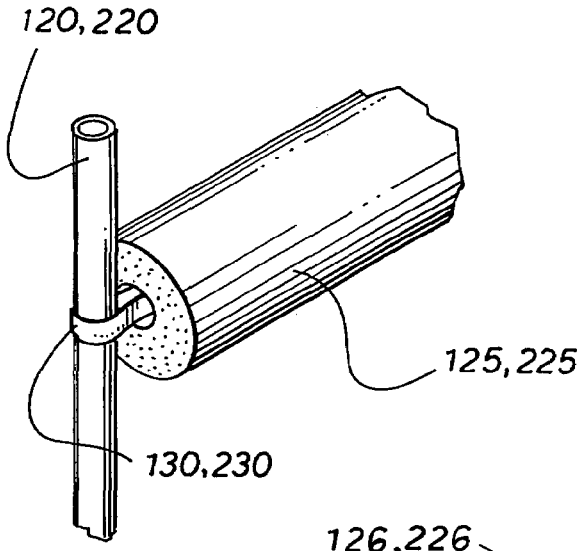
FIG. 4 illustrates a perspective close up view of an embodiment of single floatation cylinder.
Figure 5:
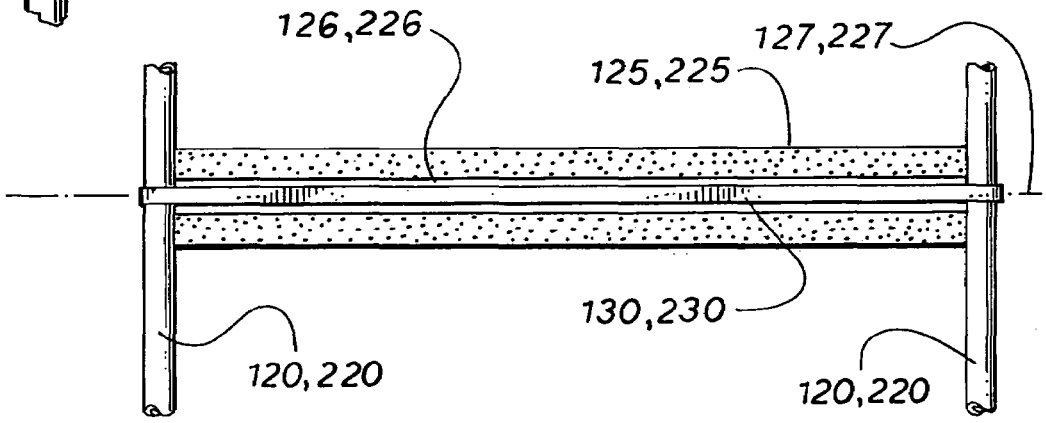
FIG. 5 illustrates a top view of an embodiment of a single floatation cylinder.

FIGS. 4–5 illustrate close up views of an embodiment of single floatation cylinder 125, 225 connected to a side tube 120, 220. As described above, the floatation cylinders 125, 225 are placed within the frame 105, 205 and held within the frame 105, 205 by elongated connecting ties 130, 120. In one embodiment, the elongated connecting connection ties 130, 230 are bands connected end to end forming a continuous loop that is disposed through the hollow centers 126,226 of each floatation cylinder 125,225, generally along the longitudinal axes 127, 227 and looped around each of the side tubes 120, 220. In one implementation, these elongated bands are packing polypropylene straps. The nylon straps have the advantage of being durable and lightweight. Furthermore, many of the bands can be preformed using conventionally available poly strapping machines. Therefore, the bands can be pre-measured and heat sealed end to end, placed over the side tubes and through the cylinders. The other side tubes can then be threaded through the looped bands and the upper and lower tubes and elbows can be added subsequently.

Figure 6:
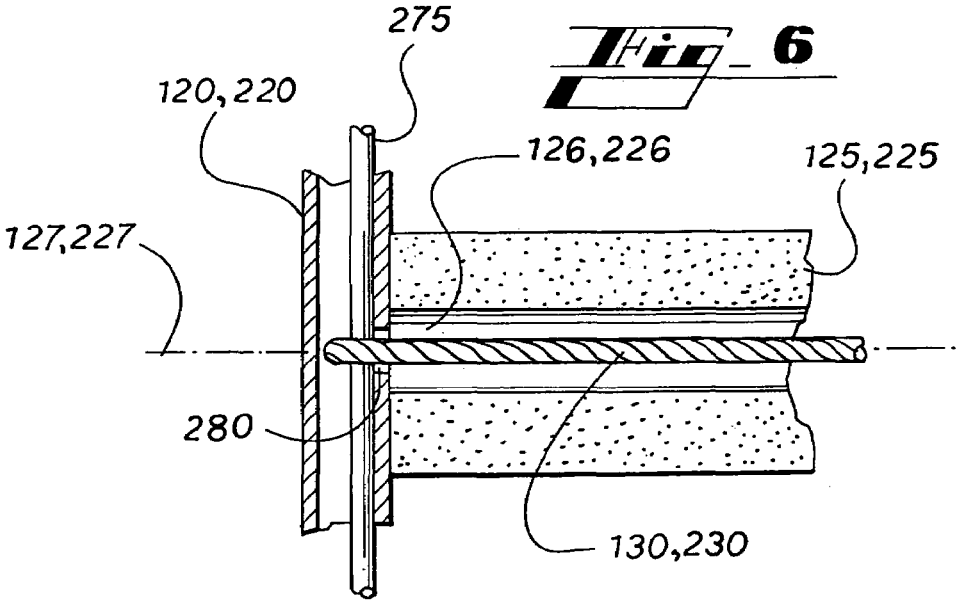
FIG. 6 illustrates a close up top view of another embodiment of a single floatation cylinder.

FIG. 6 illustrates a close up top view of another embodiment of a single floatation cylinder 125, 225 connected to side tubes 120, 220. In this embodiment, an elongated rod 275 is located within the each of the side tubes 120, 220. In a typical implementation, the rods 275 can be plastic, fiberglass or any other suitable lightweight and durable material. In addition, the side tubes 120,220 include a plurality of holes 280 aligned with an adjacent hollow center 126,226 of an adjacent floatation cylinder 125,225. In addition, the elongated connection ties 130, 230 are ropes connected end to end forming a continuous loop located within the hollow center 126, 226 of each floatation cylinder 125, 225 and through a corresponding hole 280 on each of the side tubes 120, 220, and further looped around the elongated rods 275 within the side tubes 120, 220. Therefore, one looped end of the connecting ties can be inserted into the corresponding holes on the side tubes, and the rods can be inserted into the side tubes through the loops of the connecting ties. The tines can then be inserted through the hollow centers of the cylinders and through the opposite holes on the other side tubes. The rods for those tubes can be inserted through the tubes and the loops. The upper and lower tubes and elbows can be added to complete the frames.

It is appreciated that the two different embodiment of the floatation cylinder elongated connecting ties can be mixed and matched as advantageously needed.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A floatation apparatus, comprising:

a generally polygonal frame having an upper tube parallel to a lower tube, and two parallel side tubes;

a plurality of generally adjacent and parallel floatation cylinders located within the frame, generally perpendicular to the side tubes and parallel to the upper and lower tubes, each cylinder having a hollow center along a longitudinal axis;

an elongated tie connecting each of the floatation cylinders to the frame; and an elongated rod located within the each of the side tubes, wherein the side tubes comprise a plurality of holes aligned with an adjacent hollow center of an adjacent floatation cylinder, and wherein the elongated tie is a rope connected end to end forming a continuous loop located within the hollow center of each floatation cylinder and through a corresponding hole on each of the side tubes, and further looped around the elongated rods within the side tubes.

2. The apparatus as claimed in claim 1 further comprising an additional floatation cylinder surrounding the upper tube.

3. The apparatus as claimed in claim 2 further comprising an additional floatation cylinder surrounding the lower tube.

4. The apparatus as claimed in claim 1 wherein the elongated tie is a band connected end to end forming a continuous loop that is disposed through the hollow center of each floatation cylinder and looped around each of the side tubes.

5. The apparatus as claimed in claim 1 further comprising an elbow located at each corner of the frame.

6. The apparatus as claimed in claim 1 wherein the hollow cylinders are closed cell polyethylene foam.

7. A recreational system, comprising:

a first floatation apparatus, including:

a generally polygonal frame having an upper tube parallel to a lower tube, and two parallel side tubes;

a plurality of generally adjacent and parallel floatation cylinders located within the frame, generally perpendicular to the side tubes and parallel to the upper and lower tubes, each cylinder having a hollow center along a longitudinal axis; and an elongated tie connecting each of the floatation cylinders to the frame;

a second floatation apparatus connected to the first floatation apparatus, the second apparatus including:

a generally polygonal frame having an upper tube parallel to a lower tube, and two parallel side tubes;

a plurality of generally adjacent and parallel floatation cylinders located within the frame, generally perpendicular to the side tubes and parallel to the upper and lower tubes, each cylinder having a hollow center along a longitudinal axis; and an elongated tie connecting each of the floatation cylinders to the frame; and a planar adjustment plate connected to ends of each elongated tie, wherein second ends of the frames are connected to one another by elongated ties, wherein the elongated ties are adjustable to fix an angular orientation between the two apparatuses, wherein the elongated ties adjust to a length such that the apparatuses are arranged in an angular orientation sufficient to allow a user to sit in a lounged position.

8. The system as claimed in claim 7 wherein the first and second apparatuses are hingably connected to one another at first ends of the frames by ties.

9. The system as claimed in claim 7 wherein the planar adjustment plate includes three holes, the elongated ties being knotted at one end and threaded through a first hole through an upper surface of the plate, through a second hole through a lower surface of the plate and through a third hole through the upper surface of the plate.

10. The system as claimed in claim 9 wherein the plate is triangular.

11. The system as claimed in claim 8 wherein the ties are nylon rope.

12. The system as claimed in claim 7 wherein the elongated ties are nylon rope.

* * * * *